US007699639B2

(12) United States Patent
Sun

(10) Patent No.: US 7,699,639 B2
(45) Date of Patent: Apr. 20, 2010

(54) PLUG LOCKING MECHANISM

(75) Inventor: Zheng-Heng Sun, Taipei Hsien (TW)

(73) Assignee: Hon Hai Precison Industry Co., Ltd., Tu-Cheng, Taipei Hsien (TW)

( * ) Notice: Subject to any disclaimer, the term of this patent is extended or adjusted under 35 U.S.C. 154(b) by 3 days.

(21) Appl. No.: 12/251,429

(22) Filed: Oct. 14, 2008

(65) Prior Publication Data

US 2010/0029125 A1 Feb. 4, 2010

(30) Foreign Application Priority Data

Jul. 31, 2008 (CN) ..... 2008 1 0303286

(51) Int. Cl.
*H01R 4/50* (2006.01)

(52) U.S. Cl. ..... 439/345

(58) Field of Classification Search ..... 439/345, 439/350, 352–354, 358, 744–748, 35
See application file for complete search history.

(56) References Cited

U.S. PATENT DOCUMENTS 6,024,498 A * 2/2000 Carlisle et al. ..... 385/56
6,165,026 A * 12/2000 Sugie et al. ..... 439/748
6,346,002 B1 * 2/2002 Hsu et al. ..... 439/358
6,799,898 B2 * 10/2004 Cheng et al. ..... 385/56

* cited by examiner

*Primary Examiner*—Jean F Duverne
(74) *Attorney, Agent, or Firm*—Zhigang Ma

(57) ABSTRACT

A locking mechanism is provided for securing a plug with a cable to an electronic device. The locking mechanism includes a base portion configured to abut against a side of the plug, a pressing portion slantingly extending from an end of the base portion, at least one tab protruding from the pressing portion near the base portion, and a clamping portion extending from the other end of the base portion and configured to engage with the cable.

5 Claims, 4 Drawing Sheets

PLUG LOCKING MECHANISM

BACKGROUND

1. Technical Field

The present invention relates to locking mechanisms and, more particularly, to a locking mechanism for a plug 2. Description of Related Art Referring to FIG. 4, a traditional plug 10 (such as an RJ45 plug or an RJ11 plug) is arranged at one end of a cable 20 to connect to an electronic device (such as a telephone or a computer). Typically, the plug 10 includes an integral retaining tab 11 extending therefrom for retaining the plug 10 in a socket of the electronic device. The retaining tab 11 of the plug 10 is fragile and prone to breaking during attachment and detachment of the plug 10. When this happens, it is inconvenient to replace the plug 10 with a new one.

DETAILED DESCRIPTION

Figure 1:
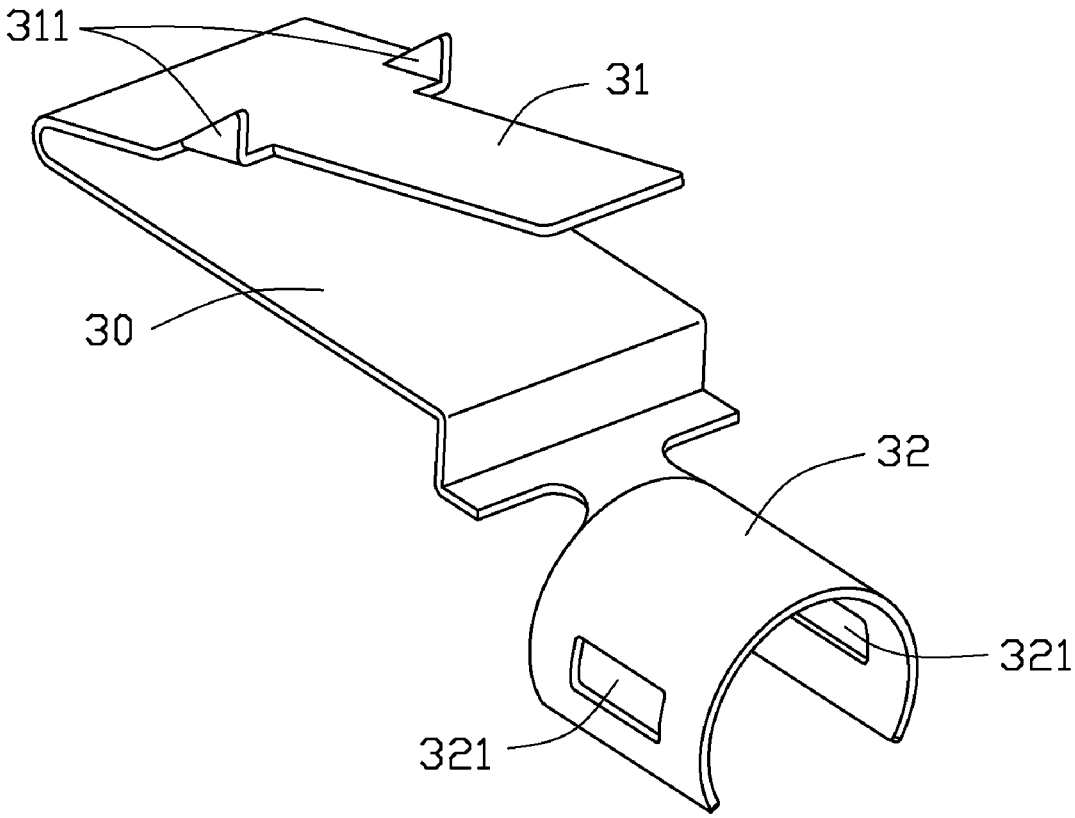
FIG. 1 is an isometric view of a locking mechanism in accordance with a first embodiment.
Figure 2:
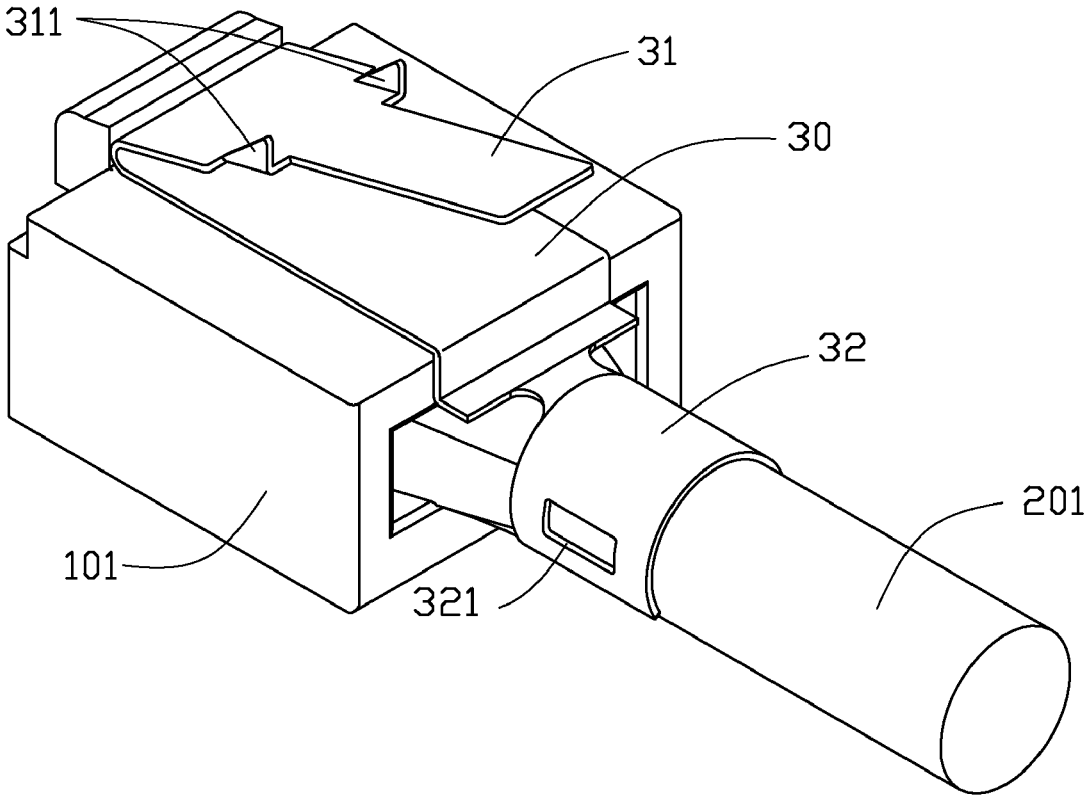
FIG. 2 is an assembled view of the locking mechanism of FIG. 1 and a plug with a broken retaining tab.

Referring to FIGS. 1 and 2, a locking mechanism in accordance with a first embodiment is provided to retain a plug 101 in a socket of an electronic device, such as a computer or a telephone. The plug 101 is connected to a cable 201.

The locking mechanism includes a substantially L-shaped base portion 30, a T-shaped resilient pressing portion 31 slantingly extending from one end of the base portion 30, and a clamping portion 32 extending from the other end of the base portion 30. The resilient pressing portion 31 is located above the base portion 30, and the clamping portion 32 is located below the base portion 30. A pair of tabs 311, each with a slanting edge, protrude from two opposite sides of a narrower part of the pressing portion 31 near a wider part of the pressing portion 31 connected to the base portion 30. The clamping portion 32 is a resilient plate, which is rolled and forms a cylinder with a gap between opposite ends of the clamping portion 32. The clamping portion 32 defines a pair of apertures 321 therein adjacent opposite sides of the gap.

The locking mechanism is attached to the plug 101, with the base portion 30 abutting against a sidewall of the plug 101, and the clamping portion 32 wrapping the cable 201 therein. A band or a tie (not shown) may pass through the apertures 321 of the clamping portion 32 to fasten the clamping portion 32 to the cable 201.

When the plug 101 is plugged into the socket of the electronic device, the wider part of the pressing portion 31 is deformably received in the socket and the slanting edges of the tabs 311 resiliently engage with an edge of the electronic device adjacent the socket to prevent the plug 101 from withdrawing from the socket. Thus, the plug 101 is retained in the electronic device. To unplug the plug 101 from the socket, the pressing portion 31 is further deformed towards the base portion 30 to release the tabs 311 from the electronic device, and then the plug 101 can be pulled out from the socket of the electronic device.

Figure 3:
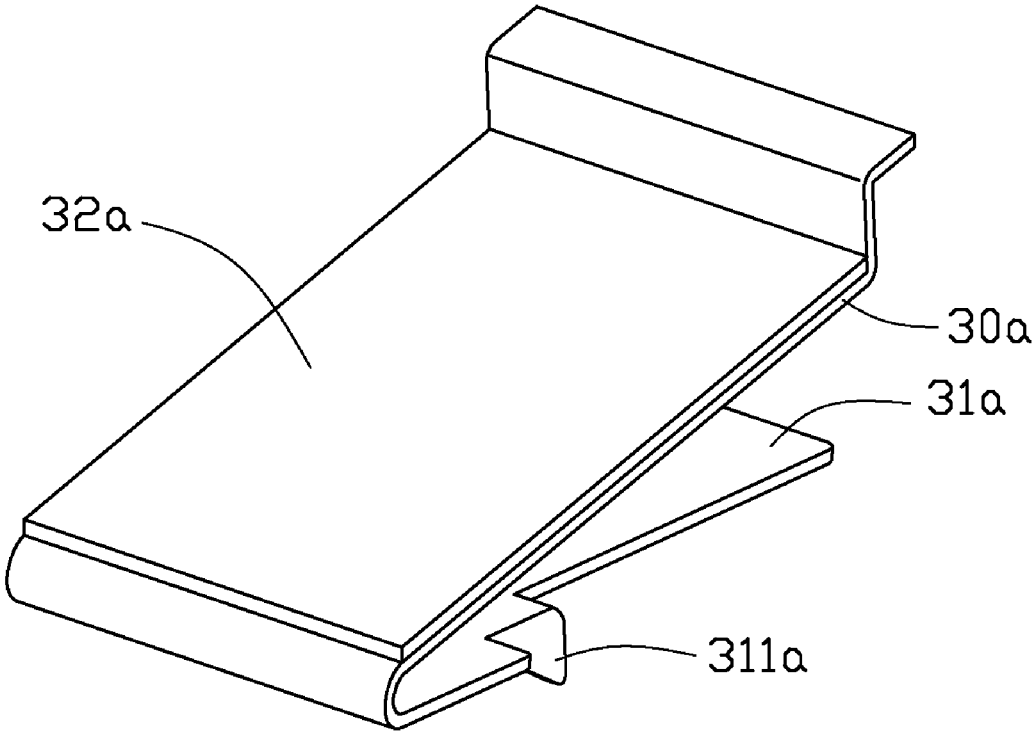
FIG. 3 is an isometric view of a locking mechanism in accordance with a second embodiment.
Figure 4:
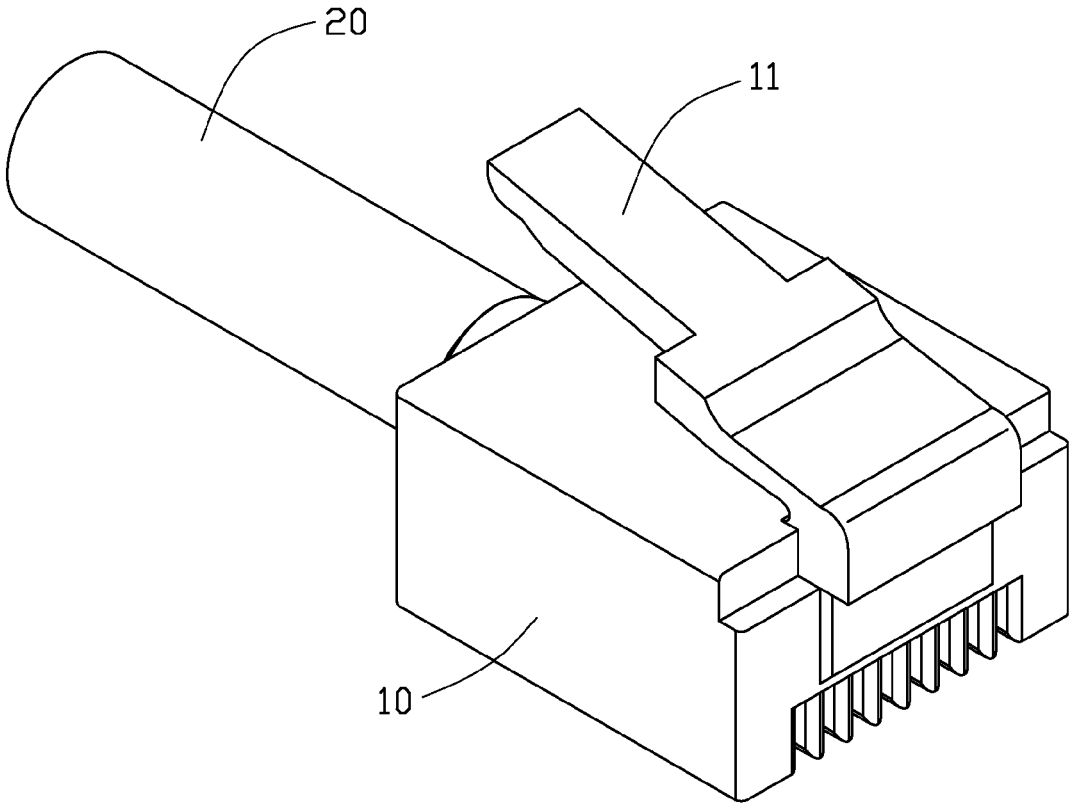
FIG. 4 (RELATED ART)
FIG. 4 is an isometric view of a related-art plug.

Referring to FIG. 3, a locking mechanism in accordance with a second embodiment includes a base portion 30*a* and a T-shaped resilient pressing portion 31*a* slantingly extending from one end of the base portion 30*a*. A pair of tabs 311*a*, each with a slanting edge, protrudes from two opposite sides of a narrower part of the pressing portion 31*a* near a wider part of the pressing portion 31*a* connected to the base portion 30*a*. An adhesive layer 32*a* is disposed on a side of the base portion 31*a* opposite to the pressing portion 31*a*. In this embodiment, the adhesive layer 32*a* is a double-sided adhesive tape with one side thereof applied to the base portion 30*a*. The plug 101 can then be adhered to the other side of the adhesive layer 32*a* to securely attach the locking mechanism to the plug 101.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A locking mechanism releasably mounted to a plug in association with a cable, and securing the plug to an electronic device, the locking mechanism comprising:

a base portion abutting against a side of the plug;

a pressing portion slantingly extending from one of two opposite ends of the base portion;

at least one tab protruding from the pressing portion near the base portion and engaging with the electronic device; and a clamping portion extending from the other end of the base portion and releasably engaging with the cable; wherein the clamping portion is generally a resilient plate, which is rolled and forms a cylinder with a gap between opposite ends of the clamping portion to wrap the cable therein; wherein the clamping portion defines a pair of apertures therein adjacent opposite sides of the gap respectively a band passes through the apertures to fasten the clamping portion to the cable.

2. A plug assembly coupling a cable to an electronic device, the plug assembly comprising:

a plug fixed to an end of the cable and inserted to the electronic device; and a locking mechanism releasably mounted to the plug and retained in the electronic device to prevent accidental disengagement of the plug from the electronic device; wherein the locking mechanism comprises: a base portion abutting against a side of the plug; a pressing portion slantingly extending from one of two opposite ends of the base portion; at least one tab protruding from the pressing portion near the base portion and engaging with the electronic device; and a clamping portion extending from the other one of the two opposite ends of the base; portion and releasably engaging with the cable; wherein the clamping portion is generally a resilient plate, which is rolled and formed a cylinder with a gap between opposite ends of the clamping portion to wrap the cable therein.

3. The plug assembly as described in claim 2, wherein the clamping portion defines a pair of apertures therein adjacent opposite sides of the gap respectively, a band passes through to fasten the clamping portion to the cable.

4. The plug assembly as described in claim 2, wherein the locking mechanism comprising:

a base portion attached to a side of the plug;

a resilient pressing portion slantingly extending from an end of the base portion;

at least one tab protruding from the pressing portion near the base portion and engaging with the electronic device; and an adhesive layer disposed on a side of the base portion to secure the base portion to plug.

5. The locking mechanism as described in claim 4, wherein the adhesive layer is a double-sided adhesive tape, one side of the adhesive layer is adhered to the base portion of the locking mechanism, the other side of the adhesive layer is adhered to the plug.

* * * * *